US005851075A

United States Patent [19]

Imai

[11] Patent Number: 5,851,075

[45] Date of Patent: Dec. 22, 1998

[54] INK JET PRINTER

[75] Inventor: Koji Imai, Nagoya, Japan

[73] Assignee: Brother Kogyo Kabushiki Kaisha, Nagoya, Japan

[21] Appl. No.: 731,919

[22] Filed: Oct. 22, 1996

[30] Foreign Application Priority Data

Nov. 7, 1995 [JP] Japan ..... 7-314719

[51] Int. Cl.[6] ..... B41J 2/365

[52] U.S. Cl. ..... 400/120.14; 347/17

[58] Field of Search ..... 400/54, 74, 174, 400/175, 120.14, 124.13; 347/14, 17

[56] References Cited

U.S. PATENT DOCUMENTS

| | | | |
|---|---|---|---|
| 5,059,044 | 10/1991 | Takaishi | 400/54 |
| 5,132,709 | 7/1992 | West | 400/120.14 |
| 5,168,284 | 12/1992 | Yeung | 347/17 |
| 5,392,065 | 2/1995 | Suzuki | 347/17 |
| 5,488,397 | 1/1996 | Nguyen et al. | 400/82 |
| 5,585,825 | 12/1996 | Kneezel et al. | 347/17 |
| 5,638,097 | 6/1997 | Takayanagi et al. | 347/14 |
| 5,664,893 | 9/1997 | Meeussen | 400/120.14 |
| 5,676,475 | 10/1997 | Dull | 400/174 |

FOREIGN PATENT DOCUMENTS

| | | | |
|---|---|---|---|
| A-62-249745 | 10/1987 | Japan | 347/17 |

*Primary Examiner*—Edgar S. Burr
*Assistant Examiner*—Steven S. Kelley
*Attorney, Agent, or Firm*—Oliff & Berridge, PLC

[57] ABSTRACT

Disclosed is an ink jet printer in which the temperature detecting circuit 8 is arranged between the thermistor 3 mounted on the ink jet head 2 and the flexible cable 7 for transmitting the signal output from the thermistor 3 to the CPU 30, and the analog signal, which is the voltage value corresponding to the temperature of the ink jet head 2, from the thermistor 3 is converted into the pulse signal (digital signal) by the temperature detecting circuit 8, the digital signal being output to the CPU 30 through the flexible cable 7, thereby the drive voltage of the ink jet head 2 is controlled according to the viscosity change of the ink occurring by the temperature change of the ink jet head 2 itself or the circumstance surrounding the ink jet head 2, by detecting the temperature of the ink jet head 2 through the thermistor 3.

13 Claims, 4 Drawing Sheets

INK JET PRINTER

BACKGROUND OF THE INVENTION

1. Field of the Invention

The present invention relates to an ink jet printer having a temperature sensor for detecting temperature of an ink jet head in order to conduct temperature management thereof. In particular, the present invention relates to an ink jet printer in which an output signal from the temperature sensor is not affected by noise signals that are ridden on the output signal while being transmitted through a flexible cable. Therefore, a drive voltage to drive the ink jet head can be flexibly set based on to viscosity change of the ink in the ink jet head occurring due to temperature change thereof. As a result, printing can be correctly conducted with good quality.

2. Description of Related Art

In general, it is well-known, in an ink jet printer, that ink viscosity in an ink jet head changes based on a temperature rise thereof while being driven or a temperature change of circumstances surrounding the ink jet head. Due to this change of the ink viscosity, an ejecting condition, such as ejecting angles or ejecting curves, of ink droplets ejected from the ink jet head changes. Thus, in the conventional ink jet printers, a temperature sensor for continuously detecting temperature of the ink jet head is arranged thereon and printing is conducted while controlling the temperature of the ink jet head within a predetermined temperature range by the temperature sensor.

Here, the conventional ink jet head in which the temperature sensor is arranged thereon will be described according to FIG. 6. FIG. 6 is a schematic view indicating an inner structure of a carriage on which the ink jet head with the temperature sensor is installed. In FIG. 6, a thermistor 53 is arranged on the ink jet head 52 installed on the carriage 51. This thermistor 53 detects the temperature of the ink jet head 52. On a print circuit board 54 set on the carriage 51, a driver IC 55 is mounted. And the ink jet head 52 is connected to the print circuit board 54 through a FPC (Flexible Print Circuit) 56 and the print circuit board 54 is connected to a CPU (not shown) through a flexible cable 57.

In the above constructed ink jet printer, the thermistor 53 detects the temperature of the ink jet head 52 which is driven on the moving carriage 51. The output signal (detected signal) from the thermistor 53 is transmitted to the CPU through the FPC 56, the print circuit board 54 and the flexible cable 57. And the output signal is input to A/D ports of the CPU and an analog signal (the output signal which is an analog voltage value corresponding to the temperature of the ink jet head 52) is converted into a digital signal, thereafter such digital signal is processed in the CPU.

However, as in the conventional ink jet printer mentioned above, in case the analog signal from the thermistor 53 is transmitted over a long distance through the flexible cable 57, and thereafter is input to the CPU and converted into the digital signal, there will occur a problem that the analog signal can become noisy while being transmitted through the flexible cable 57 due to electric noises occurring in the ink jet printer. As a result, the temperature of the ink jet head 52 cannot be correctly detected.

SUMMARY OF THE INVENTION

Accordingly, it is an object of the present invention to overcome the above mentioned problems and to provide an ink jet printer in which an output signal from the temperature sensor is not affected by noise signals that are ridden on the output signal while being transmitted through a flexible cable, so that the temperature of the ink jet head can be correctly detected.

In order to accomplish the above object, the present invention provides an ink jet printer having a carriage, an ink jet head installed on the carriage, a thermistor for detecting temperature of the ink jet head and controller for controlling drive voltage to drive the ink jet head corresponding to viscosity change of ink in the ink jet head, the viscosity change occurring according to temperature change of the ink jet head, the ink jet printer further comprising:

a flexible cable for connecting the thermistor arranged at the carriage side and the controller; and a temperature determining device connected between the thermistor and the flexible cable for converting an analog voltage value output from the thermistor into a digital signal, the digital signal being transmitted to the controller through the flexible cable.

In the above ink jet printer of the present invention, printing is conducted by ejecting ink droplets onto a print sheet while moving the carriage. During printing operation, the temperature of the ink jet head rises due to a circumstance temperature surrounding the ink jet head or a continuous printing operation. Therefore, in order to avoid influence given by temperature change of the ink jet head to printing quality, the temperature of the ink jet head is detected by the thermistor arranged at the carriage side and the drive voltage for the ink jet head is controlled by a controller, based on the viscosity change of the ink in the ink jet head. Thereby, ink droplets can be correctly ejected from the ink jet head and printing can be done with good quality.

At that time, output from the thermistor, the analog voltage value corresponding to the temperature of the ink jet head, is converted into the digital signal by the temperature determining device, thereafter the, digital signal is transmitted to the controller through the flexible cable. Therefore, the analog voltage value data can be transmitted to the controller without being affected by noises. As a result, the temperature of the ink jet head can be correctly detected.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with reference to the following drawings, wherein.

DETAILED DESCRIPTION OF THE PREFERRED EMBODIMENTS

A detailed description of the embodiment of an ink jet printer embodying the present invention will now be given referring to the accompanying drawings.

Figure 1:
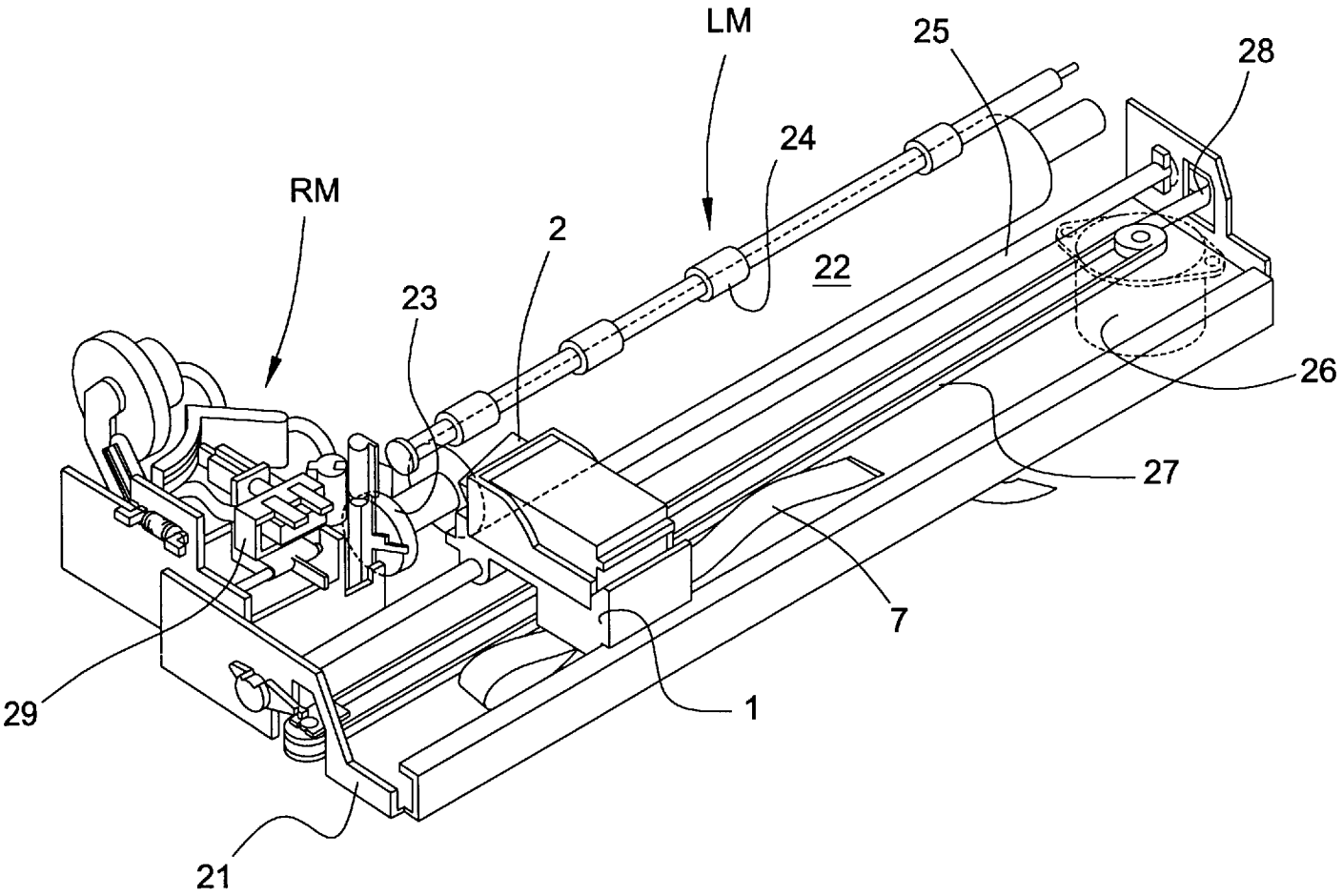
FIG. 1 is a perspective view indicating inner construction of an ink jet printer according to the embodiment of the present invention.

First, construction of the ink jet printer of the embodiment will be described according to FIG. 1. In FIG. 1, the ink jet printer basically has a subframe 21, an ink jet head 2, a recover mechanism RM for recovering the ink jet head 2 so as to correctly eject ink droplets, and a sheet feeding mechanism LM.

At the rear side in the subframe 21, a platen roller 22 is rotatably arranged. The platen roller 22 feeds print sheets supplied from a sheet supply cassette or a manual sheet supply part (not shown) along a predetermined feed path while opposing the print sheet to the ink jet head 2. At this point, the platen roller 22 constructs a part of the sheet feeding mechanism LM. And the platen roller 22 is driven by a LF motor 39 (see FIG. 2) and a platen gear 23. On the upper surface of the platen roller 22, a pressure roller 24 which presses the print sheet onto the platen roller 22 so that the print sheet is closely contacted to the platen roller 22, is arranged.

At the front side of the platen roller 22, a carriage 1 is arranged. The carriage 1 mounts the ink jet head 2 thereon and is made movable along a carriage shaft 25 arranged parallel to the platen roller 22. Thereby, the ink jet head 2 can be reciprocally moved along the platen roller 22. Further, the ink jet head 2 mounted on the carriage 1 is connected to CPU 30 (see FIG. 2) through a flexible cable 7.

At the right under side of the subframe 21, a CR motor 26 for driving the carriage 1 is positioned. The CR motor 26 drives the carriage 1 through a belt 27. As the CR motor 26, a stepper motor or a DC motor can be available. And a position gauge 28 having a tape like shape is arranged along the belt 27. The position gauge 28 has a scale thereon and is utilized for detecting the position of the carriage 1.

At the left side of the platen roller 22, the recover mechanism RM for recovering the ink jet head 2 so as to correctly eject ink droplets is arranged. The reason that the recover mechanism RM is arranged is as follows. That is, there will occur in the ink jet head 2 an inferior condition under which ink droplets cannot be correctly ejected, due to air bubbles produced in the ink jet head 2 or adherence of the ink on an ejecting plane of the ink jet head 2. Under the above inferior condition printing cannot correctly conducted. Therefore, the recover mechanism RM is arranged so that the inferior condition is recovered into a good condition where the ink droplets can be correctly ejected from the ink jet head 2. Here, as the recover mechanism RM, a purge device 29 is provided.

The purge device 29 recovers the ink jet head 2 by sucking the inferior ink from the ink jet head 2 through a negative pressure produced by a purge pump (not shown). The purge pump is driven by the LF motor 39.

Figure 2:
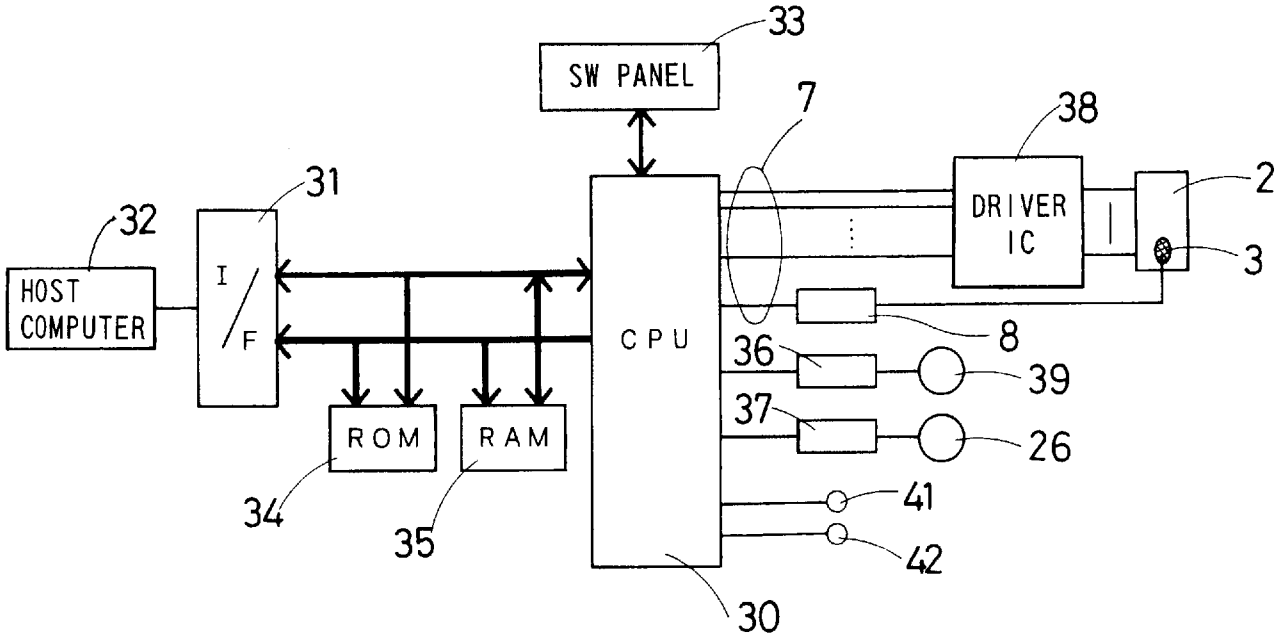
FIG. 2 is a block diagram indicating control system of the ink jet printer.

Further, the control system of the ink jet printer will be described with reference to the block diagram shown in FIG. 2. The control system is basically constructed from CPU 30 which is a wellknown central processing unit. The CPU 30 is connected to a host computer 32 through an interface 31. And to the CPU 30, a switch panel 33, ROM 34 and RAM 35 are mutually connected. Here, the switch panel 33 is utilized for setting various parameters such as sheet size, etc. and for displaying them. The ROM 34 stores various programs necessary as for control of the ink jet printer and data tables. In the ROM 34, as mentioned later, drive voltage setting program is stored through which the ink jet head 2 is driven under predetermined drive voltages according to the temperature of the ink jet head 2. The RAM 35 temporarily stores various data processed by the CPU 30.

The CPU 30 controls driving of the LF motor 39 and CR motor through a LF drive circuit 36 and a CR drive circuit 37, respectively. The LF motor 39 selectively drives one of the purge mechanism 29 and the sheet feed mechanism LM by operation of an exchanging mechanism (not shown). The CR motor 26 drives the carriage mechanism. The carriage mechanism includes the belts 27, pulleys, etc. in addition to the carriage 1.

The CPU 30 is connected to a head drive circuit 38 for driving the ink jet head 2 through the flexible cable 7 and the CPU 30 drives the ink jet head 2 through the head drive circuit 38. On the other hand, a temperature detecting circuit 8 is connected to a thermistor 3 arranged on the ink jet head 2 and the temperature detecting circuit 8 is connected to the CPU 30 through the flexible cable 7.

Further, both a sheet empty sensor 41 for detecting sheet ends of the print sheet and a home position sensor 42 for detecting a stop position of the carriage 1 are connected to the CPU 30.

Figure 3:
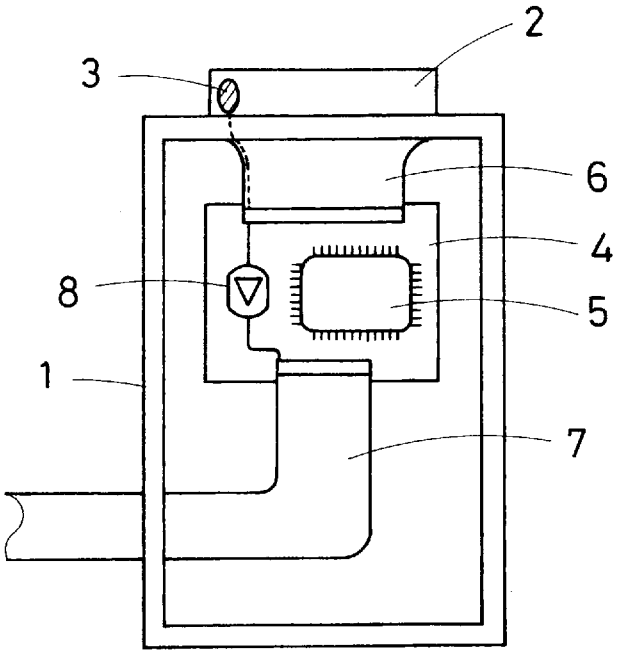
Fig. 3 is a schematic view indicating inner construction of a carriage on which the ink jet head with a thermistor is installed.
Figure 4:
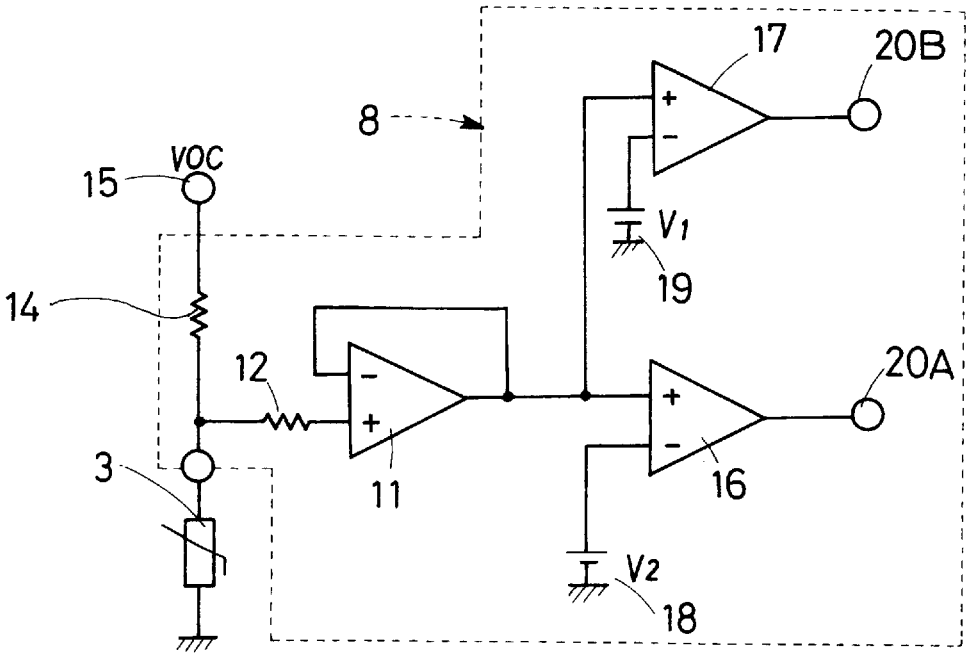
FIG. 4 is a circuit diagram of a temperature detecting circuit.

In FIG. 3, on the ink jet head 2 installed on the carriage 1, it is fixed the thermistor 3 for monitoring the temperature of the ink jet head 2. On a carriage circuit board 4 of the carriage 1, a driver IC 5 is mounted and the carriage circuit board 4 is connected to the ink jet head 2 through the FPC 6 and connected to the CPU 30 through the flexible cable 7.

Further, the temperature detecting circuit 8 is mounted on the carriage circuit board 4. In this temperature detecting circuit 8, a plus terminal of a buffer amplifier 11 is connected to the thermistor 3 through a resistor 12 and is connected to a voltage source 15 through a resistor 14. An output terminal of the buffer amplifier 11 is connected to plus terminals of the first comparator 16 and the second comparator 17. In addition, the output terminal of the buffer amplifier 11 is negatively fed back to a minus terminal thereof.

Further, reference voltages 18 (V1), 19 (V2) are connected to minus terminals of the first comparator 16, the second comparator 17, respectively. Here, in the first comparator 16, a minus pulse signal is output therefrom when it is input thereto a voltage value which represents a temperature more than 20° C. based on the voltage value from the thermistor 3, and a plus pulse signal is output therefrom when it is input thereto a voltage value which represents a temperature less than 20° C. based on the voltage value from the thermistor 3. Contrarily, in the second comparator 17, a minus pulse signal is output therefrom when it is input thereto a voltage value which represents the temperature more than 30° C. based on the voltage value from the thermistor 3, and a plus pulse signal is output therefrom when it is input thereto a voltage value which represents a temperature less than 30° C. based on the voltage value from the thermistor 3. The first comparator 16 is connected to an output terminal 20A and the second comparator 17 is connected to an output terminal 20B.

In the above constructed ink jet printer, basic operation thereof is done as follows. First, the print sheet supplied from the sheet supply cassette or the manual sheet supply part is fed by the platen roller 22 which is driven through the LF motor 39. While feeding of the print sheet, the carriage 1 and the ink jet head 2 are controlled by the CPU 30 based on instruction signals from the host computer 32. Thereby, characters, symbols or figures are printed on the print sheet by the ink jet head 2. When printing is conducted, the print line on the print sheet is fed and stopped to a position opposite to the ink jet head 2 by the platen roller 22, thereafter the carriage 1 is driven at a predetermined print speed by the CR motor 26 and ink droplets are ejected from the ink jet head 2 according to instruction signals as the carriage 1 is driven.

The temperature of the ink jet head 2 is detected and a drive voltage thereof is set according to the drive voltage setting program stored in the ROM 34, so that ink droplets are correctly ejected from the ink jet head 2. First, when the analog signal (voltage value) is output from the thermistor 3, which detects the circumstance temperature of the ink jet head 2, such analog signal is calculated and amplified by the buffer amplifier 11 and output to the plus terminals of the first comparator 16 and the second comparator 17. Thereafter, the analog signal is compared with the voltages set in the reference voltages 18, 19.

In the first comparator 16, the reference voltage 18 is set to an output voltage corresponding to the temperature 20° C., and if the analog signal exceeds the set voltage value of the reference voltage 18, that is, if the circumstance temperature of the ink jet head 2 exceeds 20° C., the analog signal output from a first thermistor 3 is converted into the digital signal. At that time, the minus pulse signal is output to the output terminal 20A. On the other hand, if the analog signal is less than the set voltage value of the reference voltage 18, that is, if the circumstance temperature of the ink jet head 2 is less than 20° C., the analog signal output from the thermistor 3 is converted into a second digital signal. At that time, the plus pulse signal is output to the output terminal 20A.

On the contrary, in the second comparator 17, the reference voltage 19 is set to an output voltage corresponding to the temperature 30° C., and if the analog signal exceeds the set voltage value of the reference voltage 19, that is, if the circumstance temperature of the ink jet head 2 exceeds 30° C., the analog signal output from the thermistor 3 is converted into a third digital signal. At that time, the minus pulse signal is output to the output terminal 20B. On the other hand, if the analog signal is less than the set voltage value of the reference voltage 19, that is, if the circumstance temperature of the ink jet head 2 is less than 30° C., the analog signal output from the thermistor 3 is converted into a fourth digital signal. At that time, the plus pulse signal is output to the output terminal 20B.

Figure 5:
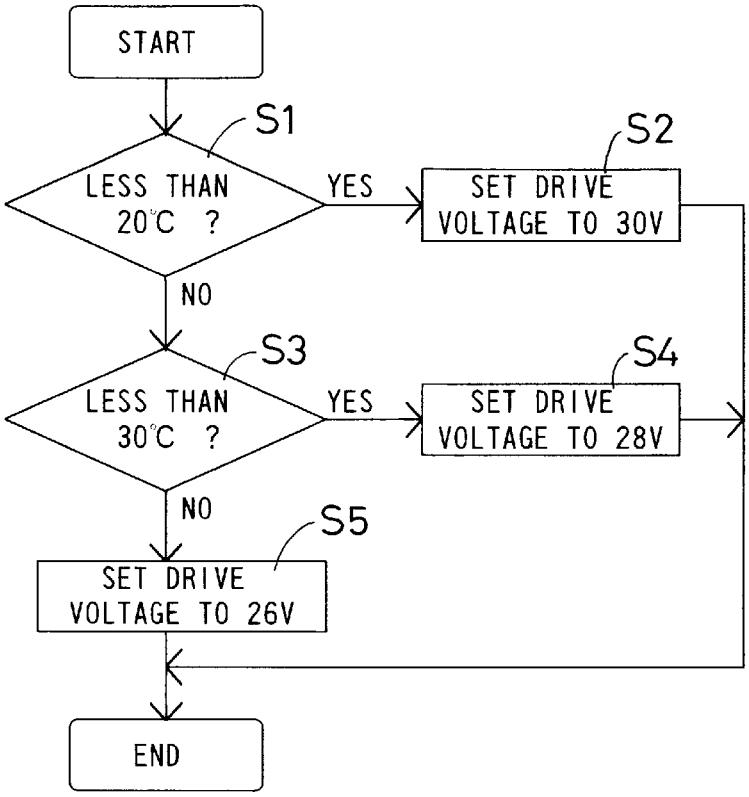
FIG. 5 is a flowchart for setting drive voltage to drive the ink jet head.
Figure 6:
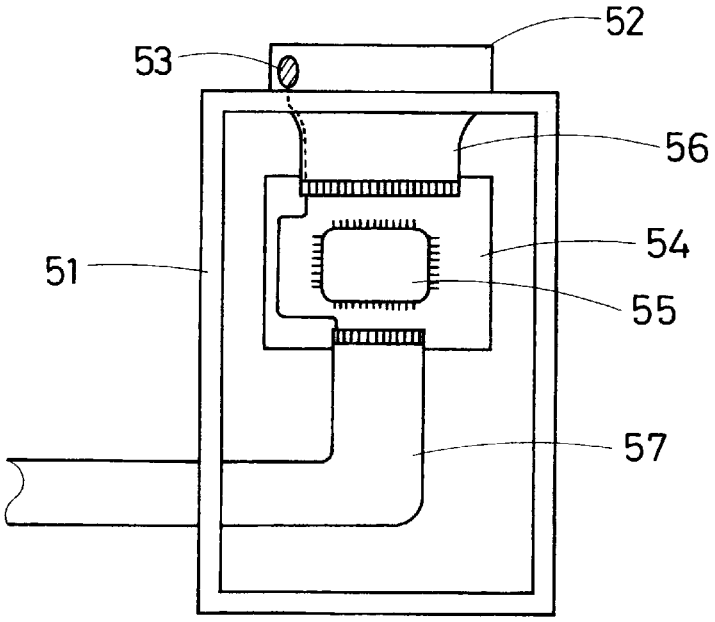
FIG. 6 is a schematic view indicating an inner construction of the carriage on which the ink jet head with the thermistor is installed, in the conventional ink jet printer.

Thereafter, the drive voltage of the ink jet head 2 is controlled based on the pulse signals output from the terminals 20A, 20B through the temperature detecting circuit 8. The operation for controlling the drive voltage of the ink jet head 2 will be described with reference to FIG. 5.

First, in step S1, it is judged whether the circumstance temperature of the ink jet head 2 is less than 20° C. or not. This judgement is conducted by recognizing whether the pulse signal from the output terminal 20A is the plus signal. When the pulse signal from the output terminal 20A is the plus signal, that is, the circumstance temperature of the ink jet head 2 is less than 20° C. (S1:YES), the drive voltage of the ink jet head 2 is set to 30 V in step S2, thereafter the program is finished.

On the other hand, when the pulse signal from the output terminal 20A is the minus signal, that is, the circumstance temperature of the ink jet head 2 exceeds 20° C. (S1:NO), it is further judged in step S3 whether the circumstance temperature of the ink jet head 2 is less than 30° C. or not. This judgement is conducted by recognizing whether the pulse signal from the output terminal 20B is the plus signal. If the pulse signal from the output terminal 20B is the plus signal, that is, the circumstance temperature of the ink jet head 2 is less than 30° C. (S3:YES), the drive voltage of the ink jet head 2 is set to 28 V in step S4, thereafter the program is finished.

If it is judged in step S3 that the circumstance temperature of the ink jet head 2 exceeds 30° C. (S3:NO), the drive voltage of the ink jet head 2 is set to 26 V in step S5, thereafter the program is finished.

As mentioned above, there will be a problem in the conventional ink jet printer that the circumstance temperature of the ink jet head cannot be correctly detected and thus the drive voltage thereof cannot be suitably set corresponding to the temperature of the ink jet head, due to the fact that noise signals are ridden on the output signal from the thermistor when an analog signal as the output signal is transmitted to the CPU through the flexible cable. On the contrary, in the ink jet printer according to the embodiment of the present invention, the analog signal corresponding to the circumstance temperature of the ink jet head 2 detected by the thermistor 3 is converted into pulse signals, that is, the digital signals in the temperature detecting circuit 8. Thereafter, the digital signals are transmitted to the CPU 30 through the flexible cable 7. Therefore, the circumstance temperature of the ink jet head 2 can be correctly detected without being affected by the noise signals.

As a result, the drive voltage of the ink jet head 2 can be suitably set according to the ink viscosity which is changed due to the temperature change around or in the ink jet head 2. Thus, printing operation can be stably done.

While the invention has been particularly shown and described with reference to preferred embodiments thereof, it will be understood by those skilled in the art that the foregoing and other changes in form and details can be made therein without departing from the spirit and scope of the invention.

While, in the ink jet printer of the embodiment, two threshold values of 20° C. and 30° C. are set to compare with the circumstance temperature of the ink jet head 2 and printing is conducted while changing the drive voltage of the ink jet head 2 based on the threshold values, it is conceivable that such threshold values can be set to the different values according to the kinds of ink and also that the circumstance temperature is detected in more stages than the embodiment by connecting another comparator in the temperature detecting circuit 8.

And though, in the ink jet printer of the embodiment, it is described that the temperature detecting circuit 8 converts the analog signal output from the thermistor 3, which is mounted on the ink jet head 2, it can utilize the temperature detecting circuit 8 to convert the analog signal output from a diode, which detects the temperature of the chip arranged in the driver IC 5.

What is claimed is:

1. An ink jet printer having a carriage, an ink jet head installed on the carriage, a thermistor for detecting temperature of the ink head and a controller for controlling a drive voltage to drive the ink jet head, the ink jet printer further comprising:

a flexible cable for connecting the thermistor arranged at the carriage side and the controller; and a temperature determining device connected between the thermistor and the flexible cable for converting an analog voltage value output from the thermistor into a digital signal before an analog data of the analog voltage value is transmitted to the flexible cable, thereafter the digital signal being transmitted to the controller through the flexible cable, the temperature determining device having at least a predetermined value set therein corresponding to a predetermined temperature, the temperature determining device judging whether the analog voltage value representing the temperature of the ink jet head exceeds the predetermined value, the temperature determining device outputting a pulse signal with one polarity when judged that the analog voltage value is less than the predetermined value and outputting the pulse signal with the opposite polarity when judged that the analog voltage value exceeds the predetermined value.

2. The ink jet printer according to claim 1, wherein the temperature determining device outputs a plus pulse signal when judged that the analog voltage value is less than the predetermined value and outputs a minus pulse signal when judged that the analog voltage exceeds the predetermined value.

3. The ink jet printer according to claim 2, wherein the controller controls the ink jet head based on a first drive voltage according to the plus pulse signal when judged by the temperature determining device that the analog voltage value is less than the predetermined value and controls the ink jet head based on a second drive voltage lower than the first drive voltage according to the minus pulse signal when judged by the temperature determining device that the analog voltage value exceeds the predetermined value.

4. The ink jet printing according to claim 1, wherein the temperature determining device comprises a temperature detecting circuit.

5. The ink jet printer according to claim 4, wherein the temperature detecting circuit includes an amplifier for amplifying the analog voltage value output from the thermistor and at least a comparator for comparing an amplified value output from the amplifier with a reference voltage set therein and outputting a pulse signal therefrom based on a comparison result thereby.

6. The ink jet printer according to claim 5, wherein the temperature detecting circuit includes a first comparator in which a first reference voltage is set and a second comparator in which a second reference voltage is set.

7. The ink jet printer according to claim 6, wherein the first reference voltage corresponds to a first voltage value representing the analog voltage value of 20° C. detected by the thermistor.

8. The ink jet printer according to claim 7, wherein the first comparator outputs a minus pulse signal when the amplified value exceeds the first voltage value and outputs a plus pulse signal when the amplified value is less than the first voltage value.

9. The ink jet printer according to claim 6, wherein the second reference voltage corresponds to a second voltage value representing the analog voltage value of 30° C. detected by the thermistor.

10. The ink jet printer according to claim 9, wherein the second comparator outputs a minus pulse signal when the amplified value exceeds the second voltage value and outputs a plus pulse signal when the amplified value is less than the second voltage value.

11. The ink jet printer according to 8, wherein the controller controls the ink jet head based on a 30V drive voltage according to the plus pulse signal and controls the ink jet head based on a drive voltage lower than 30V according to the minus pulse signal.

12. The ink jet printer according to claim 10, wherein the controller controls the ink jet head based on a 28V drive voltage according to the plus pulse signal and controls the ink jet head based on a drive voltage lower than 28V according to the minus pulse signal.

13. The ink jet printer according to claim 1, wherein the controller controls the drive voltage according to a viscosity change of ink in the ink jet head, the viscosity change occurring according to temperature change of the ink jet head.

* * * * *